United States Patent [19]

Lautenschläger

[11] Patent Number: 4,819,298

[45] Date of Patent: Apr. 11, 1989

[54] SELF-CLOSING HINGE FOR CORNER CABINETS

[75] Inventor: Reinhard Lautenschläger, Reinheim, Fed. Rep. of Germany

[73] Assignee: Karl Lautenschläger GmbH & Co. KG, Reinheim, Fed. Rep. of Germany

[21] Appl. No.: 237,852

[22] Filed: Aug. 29, 1988

[30] Foreign Application Priority Data

Sep. 4, 1987 [DE] Fed. Rep. of Germany ..... 3729531

[51] Int. Cl.[4] ..... E05D 7/04; E05F 1/12

[52] U.S. Cl. ..... 16/237; 16/292; 16/302; 16/333; 16/345; 16/347; 16/366; 16/387

[58] Field of Search ..... 16/287, 292, 297, 302, 16/323, 332, 333, 343, 345, 347, 325, 326, 294, 237, 238, 366, 386, 387, DIG. 43

*Primary Examiner*—Nicholas P. Godici
*Assistant Examiner*—Edward A. Brown

[57] ABSTRACT

Self-closing hinge for hanging the free leaf of a two-leaf corner cabinet door on the leaf that is hung on the carcase of the cabinet. The hinge has two members, one associated with each of the door leaves, which can turn by about 90° on hinge pins passing through aligned bores provided in the area of the meeting edges of the door leaves, from the position at approximately right angles to one another when the corner cabinet is closed to a position in which they are aligned substantially parallel to one another when the corner cabinet is open. The hinge members are coupled together by an elongated, strap-like connecting element which is pivotally fastened to the one member and is mounted so as to be longitudinally displaceable on the other member. This strap-like connecting element acts on the one hand as a door stop which prevents the door leaves from turning relative to one another beyond a given angle, and on the other hand it forms part of a self-closing mechanism acting when the door is closed.

8 Claims, 4 Drawing Sheets

Fig. 4
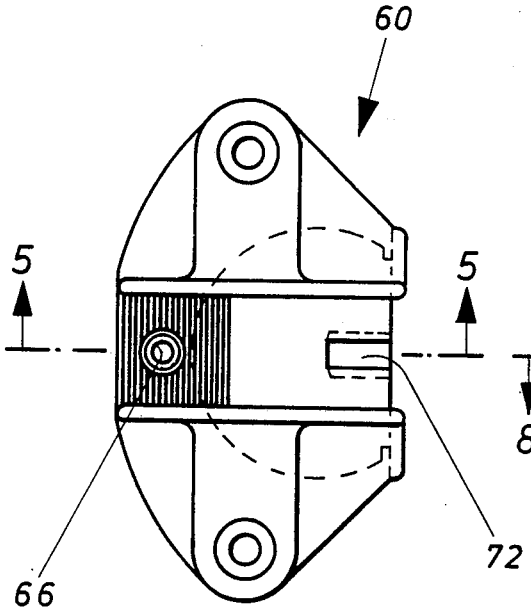
Fig. 6
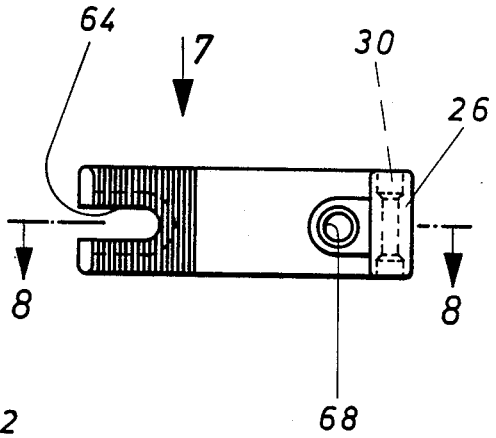
Fig. 5
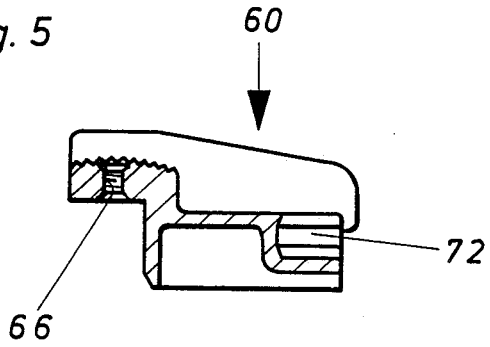
Fig. 7
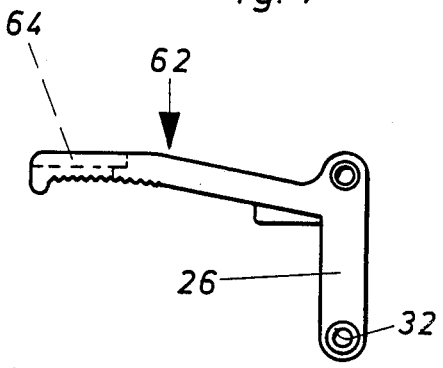
Fig. 9
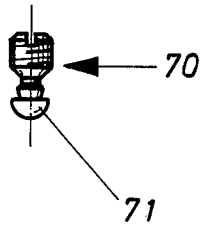
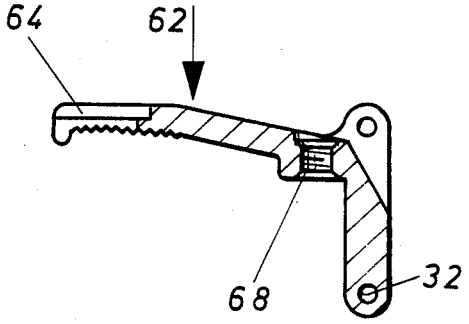
Fig. 8

Fig. 12
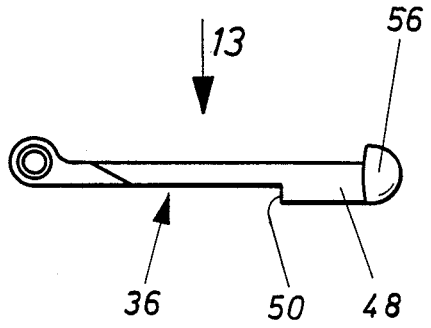
Fig. 13
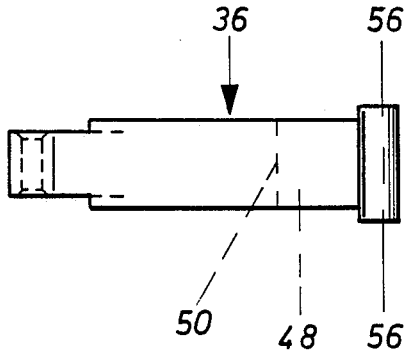
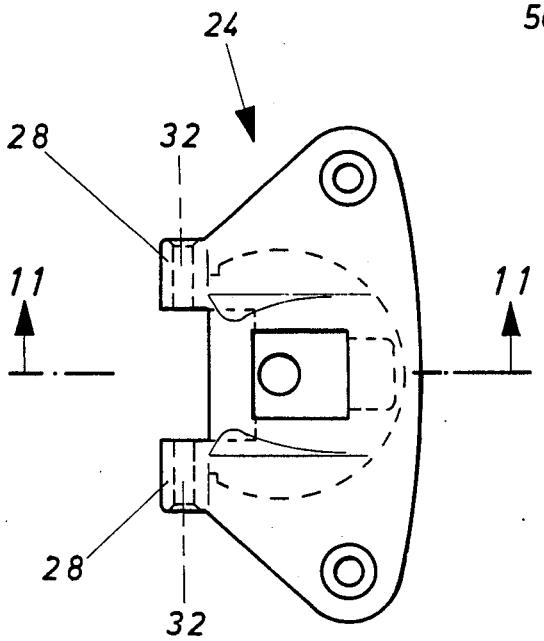
Fig. 10
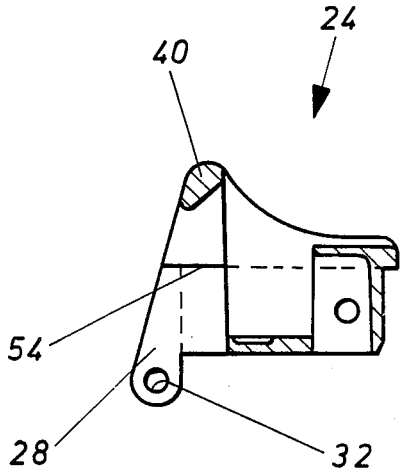
Fig. 11

SELF-CLOSING HINGE FOR CORNER CABINETS

BACKGROUND OF THE INVENTION

The invention concerns a self-closing hinge for hanging the free leaf of a two-part corner cabinet door on the carcase-hung door leaf, the self-closing hinge consisting of two hinge members, each associated with one of the leaves, which by means of a hinge pin passing through aligned bores provided adjacent the meeting edges of the leaves can be turned by about 90° from the position in which, in the closed state of the corner cabinet, the leaves are held approximately at right angles to one another, to a substantially parallel-aligned position when the corner cabinet door is open.

Such corner cabinets, which fill the corner area of two rows of built-in cabinets running at right angles to one another, are used especially as floor cabinets and wall cabinets in the furnishing of kitchens. The door on the corner cabinet is divided, on account of space requirements, into two leaves of which one is hung on the corner cabinet with conventional hinges, while the second, free door leaf is hinged to the first leaf such that, when the door is closed, it will be at a right angle to the first leaf, but when the cabinet is opened it can be swung to a position in which it is aligned with the first leaf. Formerly, so-called piano hinges have been used for joining the two leaves together, but they have the disadvantage that a self-closing mechanism cannot be incorporated into them so as to hold the free leaf pressed against its associated part of the cabinet when the whole door is closed. Even when the carcase-hung door leaf was hung with normal self-closing hinges, the free leaf had to be held closed by a separate self-closing mechanism, such as a magnetic door closer. Such self-closing mechanisms separate from their corresponding hinges, however, have components to be mounted on the cabinet which are in every case visible when the door is open, and not only do they detract from the appearance of the (open) corner cabinet, but also they interfere with access thereto.

The invention is therefore addressed to the problem of creating a self-closing hinge for a two-leaf door of a corner cabinet, for hanging the free leaf on the leaf that is hung on the carcase, which will incorporate a self-closing mechanism so that the use of a separate self-closing mechanism will be unnecessary.

SUMMARY OF THE INVENTION

Setting out from a hinge of the kind mentioned above, this problem is solved according to the invention in that the first hinge member disposed substantially on the inside of the carcase-hung door leaf has at least one corner projection extending to the area of its front edge, in whose free end the bore for the hinge pins is provided. The second hinge member is furthermore configured as a recess-mounting cup disposed in a mortise made in the inside of the free leaf and broken out at the edge thereof, and likewise has at least one corner projection which extends from the edge of the free door leaf into the area of its front edge, and which is offset in height from the corner projection of the first hinge member and has a bore provided in alignment with the bore provided in the free end of the corner projection of the first hinge member. To the first hinge member on the door-leaf interior there is also articulated an elongated band-like or strap-like connecting element whose free end is brought through a slot-like gap under a cross-bar of the second hinge member, the gap being defined at the end opposite the cross-bar by a cam surface of a self-closing element biased by a spring toward the cross-bar. In its area facing the cam surface of the self-closing element when the corner cabinet door is closed, the connecting element furthermore has a step-like, thickened end section while the transitional surface forming the step engages the cam surface of the self-closing element such that the cam surface is displaced against the bias of the spring acting on the self-closing element to produce an increase in the size of the slot-like gap between the crossbar and the cam surface.

In an advantageous further development of the invention, in the second hinge member at least one abutment surface for the self-closing element is provided in such a position that the distance existing between the crossbar and the associated cam surface of the self-closing element when the self-closing element engages the abutment surface is approximately equal to or slightly greater than the thickness of the band-like or strap-like connecting element outside of its thickened end section.

Also, it is desirable that the self-closing element be pivotingly mounted in the area remote from the corner projection inside of the second hinge member and that the associated spring be a compression spring held at one end under bias on the bottom of the second hinge member and in a recess in the confronting bottom of the self-closing element at the other, which urges the end of the self-closing element that is provided with the cam surface into contact with the abutment surfaces of the second hinge member.

In an advantageous improvement of the invention, an additional function can be associated with the elongated connecting element by providing bolsters at the free end of the thickened end section of the connecting element, which, when the second hinge member turns relative to the first hinge member, thereby reducing the angle included between the door leaves associated therewith, will come into contact with associated contact surfaces on the second hinge member after a turn angle of no more than about 15°. This will bring it about that the free door leaf will be able to turn relative to the carcase-hung door leaf by only such an amount that its free edge will reliably come free from the adjacent edge of the door of the cabinet next following, and the connecting element will then permit no further turning, i.e., will act additionally as a door stop so as to prevent the self-closing mechanism of the hinge here in question from being overstressed by the further opening of the door.

The leaf of the door that is hinged to the carcase of the corner cabinet is, as a rule, hung with wide-angle hinges which are also provided with a self-closing mechanism. In that case it is recommended that the closing force of the self-closing hinge holding the free door leaf in the closed position be made weaker than the holding force of the self-closing hinge holding the carcase-hung door leaf in the closed position, so that, when the door of the corner cabinet is opened, first the free door leaf will move slightly away from the cabinet while the self-closing mechanism of the wide-angle hinges will at first still hold the carcase-hung door in the closed position. Then, when the opening force is increased so that the holding force of the wide-angle hinges is also overcome, the leaf that is hinged to the carcase will also open, so that the door as a whole can thus be opened.

The first hinge member is best composed, like the conventional hinges holding cabinet doors on the carcase of cabinets, of a mounting plate held in this special case at least partially sunken in an associated mortise in the inside of the door-leaf hung on the carcase, and of a supporting arm which can be displaced at right angles to the adjacent edge and substantially parallel to the inside of the door leaf and can be locked at selectable positions, on whose end facing the second hinge member the corner projection is provided. Owing to the possibility of shifting the supporting arm it then becomes possible to reduce the gap existing between the leaves to a very small size, both when the door is open and when it is closed.

It is furthermore advantageous if the supporting arm is fastened so as to be additionally adjustable in its end portion bearing the corner projection at approximately right angles to the inside of the door leaf and so as to be lockable in selectable positions on the mounting plate. This makes possible an additional alignment of the two door leaves relative to one another, such that the leaves can be adjusted in regard to their precise alignment with one another when the door is closed.

In that case it is best that the elongated connecting element be pivotingly held between two laterally spaced projections provided in the area of transition from the corner projection to the supporting arm, by passing a hinge pin through aligned bores in the laterally spaced projections and in the connecting element placed between these projections, and fixing it in those projections.

BRIEF DESCRIPTION OF THE DRAWING

The invention will be further explained in the following description of an embodiment, in conjunction with the drawing wherein:

FIG. 4 is a top view of the mounting plate of the self-closing hinge seen in the direction of the arrow 4 in FIG. 2, FIG. 5 is a cross section seen in the direction of the arrows 5—5 in FIG. 4, FIG. 6 is a bottom view of the supporting arm which can be fastened on the mounting plate shown in FIGS. 4 and 5, FIG. 7 is a side view of the supporting arm seen in the direction of arrow 7 in FIG. 6, FIG. 8 is a cross section of the supporting arm seen in the direction of the arrows 8—8 in FIG. 6, FIG. 9 is a side view of an adjusting screw holding the supporting arm adjustably on the mounting plate, FIG. 10 is a plan view of the part of the self-closing hinge that is associated with the free door leaf, seen in the direction of the arrow 10 in FIG. 2, FIG. 11 is a cross section seen in the direction of the arrows 11—11 in FIG. 10, FIG. 12 is a side view of the elongated connecting element of the self-closing hinge shown in FIGS. 2 and 3, and FIG. 13 is a top view of the connecting element seen in the direction of the arrow 13 in FIG. 12.

DESCRIPTION OF PREFERRED EMBODIMENT

Figure 1:
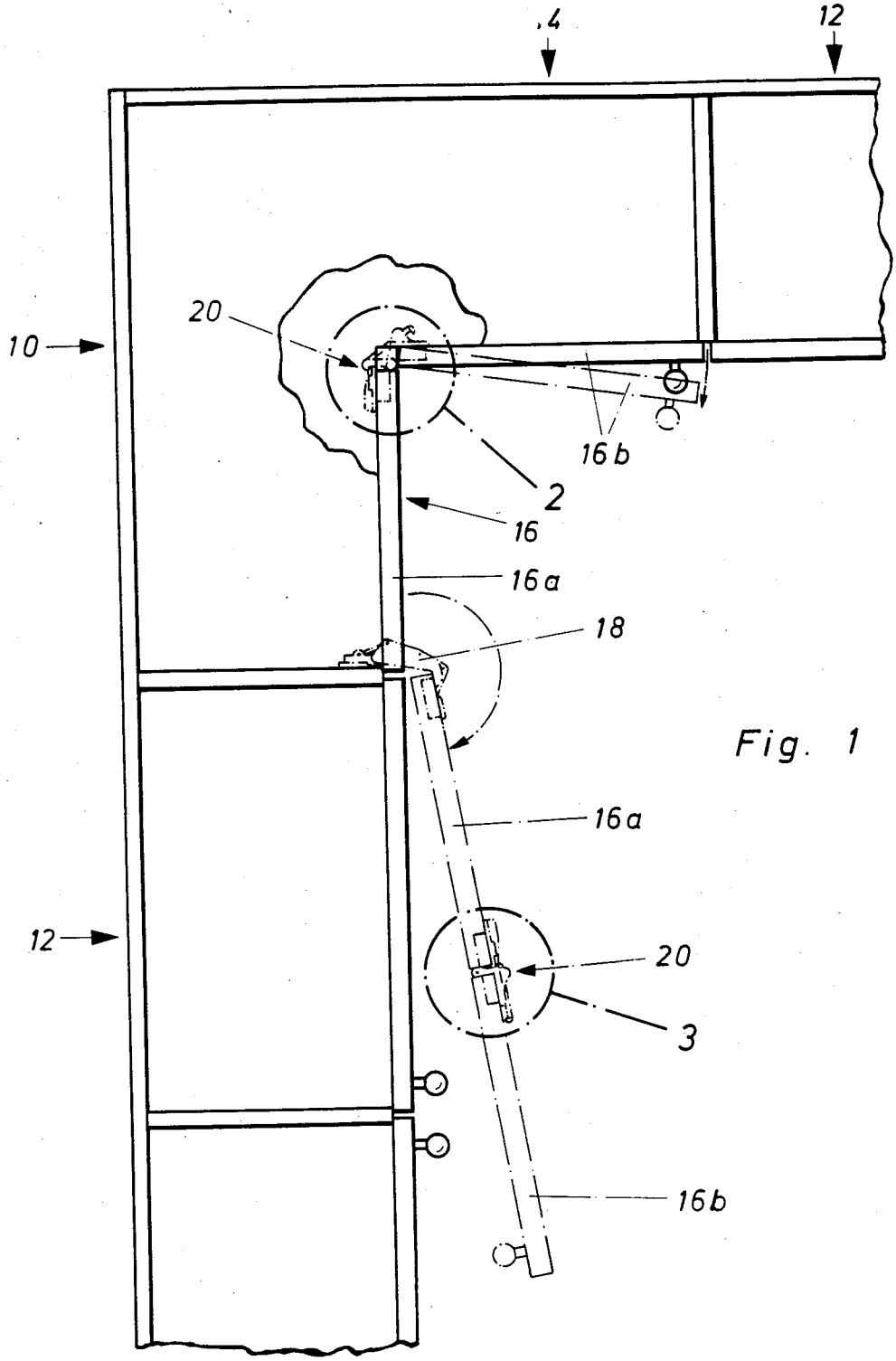
FIG. 1 is a top plan view of a corner cabinet with the top cover cut away at the corner, and with additional cabinets adjoining it at both ends, the door being shown in the closed position, with the free door leaf additionally represented in broken lines as it is moved slightly away from the cabinet as opening begins, and the entire door represented in broken lines in the fully open position.

FIG. 1 is a top view of a portion of a corner cabinet 10 which forms part of a set of built-in cabinets, and which in the present case is a wall cabinet directly adjoined on both sides by additional (normal) wall cabinets 12. The carcase 14 of the corner cabinet 10 is closed on the front side by a door 16 which consists of two leaves **16*a* and 16*b* of which the first leaf 16*a* is hung, by means of conventional wide-angle hinges 18 provided with an integral self-closing mechanism, to a side wall of the corner cabinet carcase 14, which appears horizontal in FIG. 1, but actually is vertical as seen when looking into the cabinet interior from the front. In the area of the free vertical edge of this door leaf 16*a* hung on the carcase, the second, or free, door leaf 16*b* is hinged by means of the self-closing hinges 20 which will be described in detail below in conjunction with FIGS. 2 to 13. It is thus possible to open the door 16 of the corner cabinet 10 by first opening the leaf 16*b* against the force of the self-closing hinges 20 linking it to leaf 16*a* and biasing it against the carcase 14, in the manner indicated in broken lines, to such an extent that the free vertical edge of the leaf 16*b* comes away from the associated edge of the adjacent wall cabinet 12. The amount by which the door leaf 16*b* opens is limited by the self-closing hinge 20 to approximately the angle represented in broken lines, so that further opening of the door 16 is possible only by a pivoting of the leaf 16*a*. This overcomes the holding force of the self-closing mechanism of the wide-angle hinges 18, and the entire door 16 can then be swung effortlessly to the open position represented also in broken lines in FIG. 1, in which the two then-aligned leaves 16*a*, 16*b*, are directly in front of the adjacent wall cabinet 12, represented at the bottom in FIG. 1, and the interior of the corner cabinet 10** becomes perfectly accessible.

Figure 2:
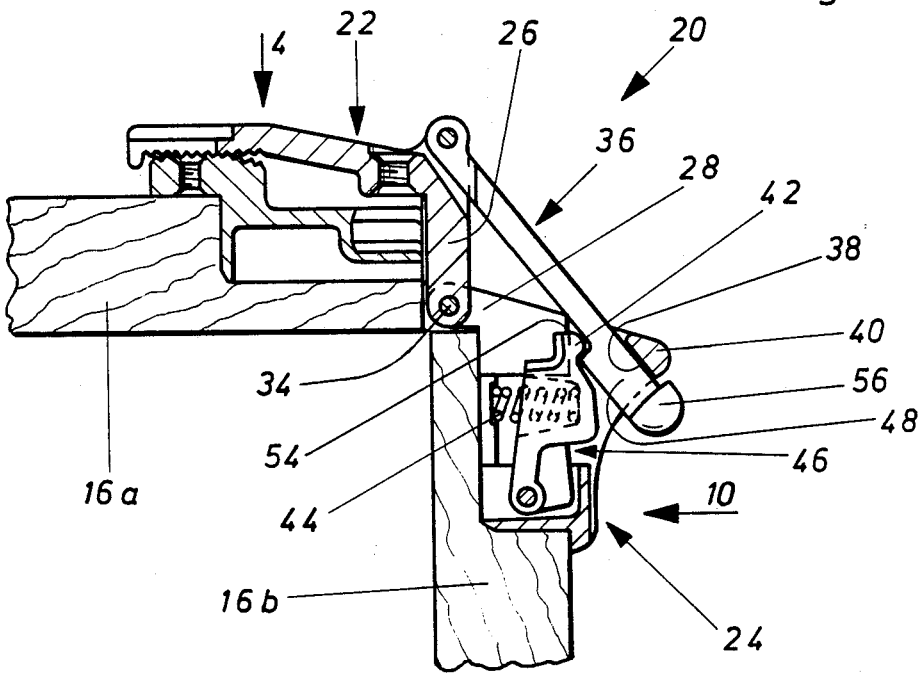
FIG. 2 represents the area of the corner cabinet door lying within the broken circle 2 in FIG. 1, with the self-closing hinge according to the invention in the closed position.
Figure 3:
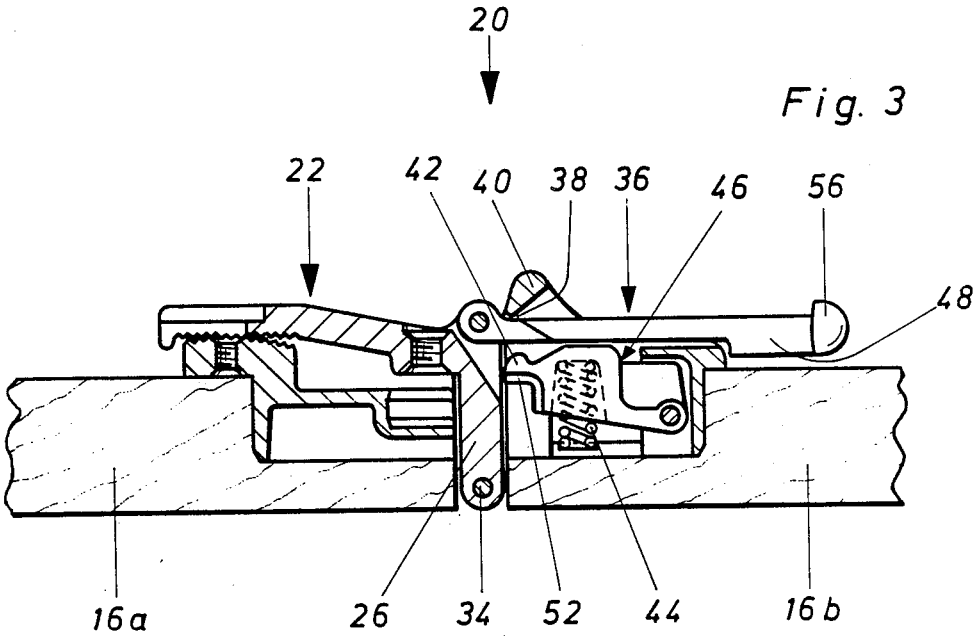
FIG. 3 is a view corresponding to FIG. 2 showing the area of the door within the broken circle 3 in FIG. 1 with the door open.

The self-closing hinges 20 forming the subject matter of the invention are shown in FIGS. 2 and 3 in the fully closed and fully open position, respectively, of the door 16. The hinge 20 is composed of a first part 22 disposed substantially on the inside, but in part also sunken in a recess in the carcase-hung door leaf **16*a*, and a second part 24 fastened on the inside of the second leaf 16*b*, but with a section in the form of a cup likewise disposed offset in a recess in the door leaf 16*b*, each having corner projections 26, 28, which extend in front of the edge of the associated leaf 16*a*, 16*b*, to a point close to its front edges. The corner projections 26, 28, are offset from one another vertically and have in the area of their free ends aligned bores 30 and 32 through which a common hinge pin 34 is passed. The hinge pin 34 thus defines the location of the pivot axis of the self-closing hinge 20**.

The two hinge members 22 and 24 are joined together by an elongated, strap-like connecting element 36 which is articulated at one end to the hinge member 22, and which then is passed through a slot-like gap 38 in the second hinge member 24. This gap 38 is formed at one end by a crossbar 40 provided on this hinge member and at the opposite end by a cam 42 which is part of a self-closing element 46 disposed in the interior of the second hinge member 24 and biased toward the crossbar 40 by a spring 44. The connecting element 36, which is also represented separately in FIGS. 12 and 13, is provided in the area facing the cam 42 of the self-closing element 46, when the corner cabinet door is closed (FIG. 2), with a thickened end section 48 adjoining via a transitional surface in the form of a step 50 on the thinner and longer section of the connecting element. It is apparent that the transitional surface forming the step 50 lies against the cam 42 when the corner cabinet is closed, and forces the self-closing element 46 against the bias of the spring 44 slightly into the interior of the hinge member 24. The holding force urging the free door leaf **16*b* against the carcase 14 is produced as a reaction of the bias stored in the spring 44. The self-closing element 46 is, as it can be seen in FIGS. 2 and 3, articulated in the interior of its hinge member at its end remote from the cam 42, and it has in its area under the cam lateral projections 52 with which abutment surfaces 54 are associated which are provided in the interior of the hinge member 24 (FIG. 11 and FIG. 2). The self-closing element 46 can thus be turned only until its lateral projections 52 engage the abutment surface 54, and then the slot-like gap 38 between the crossbar 40 and the cam 42 remains, whose height is approximately equal to or slightly greater than the thickness of the elongated, thinner section of the connecting element 36. When the door leaf 16*b* turns relative to the door leaf 16*a* thereby increasing the angle included between the two door leaves, the thinner section of the connecting element 36 thus passes freely through the gap 38. If, on the other hand, the leaf 16*b* is turned in the opposition direction relative to leaf 16*a*, i.e., reducing the angle included between the two leaves, the transitional surface forming the step 50 forces the cam 42 downwardly, thereby increasing the bias of spring 44 of the self-closing element and thus increasing the closing force. But the above-mentioned turning of leaf 16*b* is possible only until the laterally extending bolsters 56 provided at the free end of the thickened end section 48 come into engagement with the cheeks holding the crossbar 40 laterally. Then no further turning is possible, i.e., the connecting element 36** then acts as a door stop.

The first hinge member 22 is composed of two pieces shown in FIGS. 4 and 5 on the one hand and FIGS. 6 and 8 on the other, namely a mounting plate 60 to be partially recessed in the previously mentioned opening in the door leaf **16*a*, and a supporting arm 62 which can be shifted and adjusted in two coordinate directions and can be locked at selected settings on the mounting plate. The mounting plate 60 is similar in form to a so-called "wing plate" in conventional hinges, i.e., it is fastened by screwing lateral wing-like projections onto the inside of the door leaf 16*a*, differing from the normal wing plates substantially in the fact that, in its central area holding the supporting arm, it is partially recessed to achieve the lowest possible profile above the inside of the door. The manner in which the elongated supporting arm 62 is fastened on this central part, however, is basically comparable with conventional hinges, so that there is no need to go into detail in this regard. It is to be mentioned only that the fastening of the rearward end, i.e., the end facing away from the corner projection 26 of the supporting arm 62, is performed by a screw (not shown) which passes through a slot 64 open at the rearward end, and is driven into a tap 66 in the mounting plate 60. The adjusting screw 70 represented separately in FIG. 9 is threaded into a tap 68 adjacent the elbow of the angled supporting arm 62, whose especially shaped holding head 71 projecting from the bottom of the supporting arm 62 can be inserted into an associated open groove 72 in which the head is held against removal at right angles to the inside of the door leaf 16*a*, although it is displaceable in the groove 72 and also remains turnable to vary the angular position of the supporting arm 62 relative to the mounting plate 60 (and thus to the inner surface of the door leaf 16*a*). It is clear that, by displacing the supporting arm 62 longitudinally on the middle area of the mounting plate 60 and by turning the adjusting screw 70, a change can be made in the relative position of the supporting arm and thus also of the corner projection 26 with respect to the door leaf 16*a*, so that therefore the size of the gap existing between the door leaves 16*a* and 16*b* when the door 16** is closed can be varied.

I claim:

1. A self-closing hinge for hanging a first, free leaf of a two-part corner door of a cabinet on a second door leaf hung on a carcase of the cabinet, comprising: a first hinge member to be disposed on the inside of the second door leaf, said first hinge member having at least one first corner projection extending close to an edge of the first door leaf, said corner projection having a free end with a first bore, a hinge pin in said first bore and about which said first and second leaves are pivotable by 90° from a first position in which the leaves are held approximately at right angles to one another when the corner cabinet is closed, to a second position in which the leaves are aligned parallel to each other when the corner door is open, and vice versa; a second hinge member, configured as a recess-mounting cup disposed in a mortise in the inside of the first leaf and broken out at an edge thereof, said second hinge member having at least one second corner projection which extends close to a front edge of the first door leaf, and which is offset in height from said first corner projection and has a second bore in alignment with said first bore, said second hinge member having a crossbar; a self-closing element having a cam surface opposite said crossbar so as to define therewith a gap; an elongated strap-like connecting element articulated to said first hinge member and having a free end extending through said gap, a spring biasing said self-closing element toward said crossbar; said connecting element having an end section facing said cam surface when the corner door is closed, and also having a transitional surface forming a step adjacent said end section, which comes into engagement with said cam surface so that the latter is displaced against the bias of the spring in the sense of an increase in the size of the gap between said crossbar and said cam surface.

2. A self-closing hinge according to claim 1, wherein said second hinge member has at least one abutment surface for the self-closing element in such a position that the distance between the crossbar and said cam surface when the self-closing element engages the abutment surface is approximately equal to or slightly greater than the thickness of the strap-like connecting element outside said end section.

3. A self-closing hinge according to claim 2, wherein said self-closing element is pivotingly mounted remote from said second corner projection inside said second hinge member, and said spring is a compression spring having one end held under bias on a bottom of said second hinge member and another end held in a recess in a confronting bottom of said self-closing element, said spring urging an end of the self-closing element provided with said cam surface into contact with said abutment surface of said second hinge member.

4. A self-closing hinge according to any one of claims 1 to 3, comprising bolsters at a free end of said end section of said connecting element; when said second hinge member turns relative to said first hinge member and reduces the angle between said two door leaves said bolster coming into contact with associated contact surfaces on said hinge member after a turn angle of no more than about 15°.

5. A self-closing hinge according to any one of claims 1 to 3, wherein said first hinge member is composed of a mounting plate held at least partially sunken in an associated mortise in the inside of the second door leaf, and of a supporting arm displaceable at right angles to an adjacent edge of and substantially parallel to the inside of said second door leaf, and means for locking said supporting arm at selectable positions relative to said mounting plate, said supporting arm having an end on which said first corner projection facing said second hinge member is provided.

6. A self-closing hinge according to claim 5, wherein said supporting arm is fastened so that said end bearing said first corner projection is adjustable so as to be at approximately right angles to the inside of said second door leaf, and means for locking said supporting arm in selectable positions on said mounting plate.

7. A self-closing hinge according to claim 1, comprising two laterally spaced projections between said first corner projection and said supporting arm, said connecting element being pivotingly held between said two projections.

8. In combination: a first self-closing hinge hanging a first, free leaf of a two-part corner door of a cabinet on a second door leaf, and a second self-closing hinge connecting said second door leaf on a carcase of the cabinet; said first self-closing hinge comprising: a first hinge member to be disposed on the inside of the second door leaf, said first hinge member having at least one first corner projection extending close to an edge of the first door leaf, said corner projection having a free end with a first bore, a hinge pin in said first bore and about which said first and second leaves are pivotable by 90° from a first position in which the leaves are held approximately at right angles to one another when the corner cabinet is closed, to a second position in which the leaves are aligned parallel to each other when the corner door is open, and vice versa; a second hinge member, configured as a recess-mounting cup disposed in a mortise in the inside of the first leaf and broken out at an edge thereof, said second hinge member having at least one second corner projection which extends close to a front edge of the first door leaf, and which is offset in height from said first corner projection and has a second bore in alignment with said first bore, said second hinge member having a crossbar; a self-closing element having a cam surface opposite said crossbar so as to define therewith a gap; an elongated strap-like connecting element articulated to said first hinge member and having a free end extending through said gap, a first spring biasing said self-closing element toward said crossbar; said connecting element having an end section facing said cam surface when the corner door is closed, and also having a transitional surface forming a step adjacent said end section, which comes into engagement with said cam surface so that the latter is displaced against the bias of said first spring in the sense of an increase in the size of the gap between said crossbar and said cam surface; said second self-closing hinge having a second spring; the structure and arrangement of said first and second hinges including said first and second springs is such that the force holding said first door leaf in closed position is weaker than the force holding the second door leaf to the cabinet carcase.

* * * * *